US009022504B2

(12) United States Patent
Ohtsuka

(10) Patent No.: US 9,022,504 B2
(45) Date of Patent: May 5, 2015

(54) METHOD AND DEVICE FOR ACHIEVING COLOR DEVELOPMENT ON A PRINT MEDIUM BY INK JET PRINTING

(75) Inventor: Shuichi Ohtsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 574 days.

(21) Appl. No.: 13/395,861

(22) PCT Filed: Jul. 21, 2010

(86) PCT No.: PCT/JP2010/004664

§ 371 (c)(1),
(2), (4) Date: Mar. 13, 2012

(87) PCT Pub. No.: WO2011/030496

PCT Pub. Date: Mar. 17, 2011

(65) Prior Publication Data

US 2012/0182345 A1 Jul. 19, 2012

(30) Foreign Application Priority Data

Sep. 14, 2009 (JP) ..... 2009-211579
Jan. 26, 2010 (JP) ..... 2010-014756

(51) Int. Cl.
*B41J 2/205* (2006.01)
*B41J 2/21* (2006.01)

(52) U.S. Cl.
CPC ..... *B41J 2/2114* (2013.01); *B41J 2/2107* (2013.01)

(58) Field of Classification Search
CPC ..... B41J 2/2107; B41J 2/2114
USPC ..... 347/15, 101, 95; 106/31.27
See application file for complete search history.

(56) References Cited

U.S. PATENT DOCUMENTS

| | | | | |
|---|---|---|---|---|
| 5,792,249 | A * | 8/1998 | Shirota et al. | 106/31.27 |
| 5,933,164 | A | 8/1999 | Sato et al. | |
| 5,984,454 | A | 11/1999 | Takahashi et al. | |
| 6,612,675 | B1 | 9/2003 | Takahashi | |
| 2002/0054196 | A1 * | 5/2002 | Kuwahara | 347/101 |
| 2004/0201656 | A1 | 10/2004 | Koitabashi et al. | |

(Continued)

FOREIGN PATENT DOCUMENTS

| | | |
|---|---|---|
| EP | 0788885 A2 | 8/1997 |
| JP | 06-206349 | 7/1994 |

(Continued)

OTHER PUBLICATIONS

Notification of Reasons for Refusal issued by JPO on Jun. 3, 2014 in connection with corresponding Japanese Patent Application No. 2012-502787.

(Continued)

*Primary Examiner* — Julian Huffman
*Assistant Examiner* — Carlos A Martinez
(74) *Attorney, Agent, or Firm* — Jean C. Edwards, Esq.; Edwards Neils PLLC

(57) ABSTRACT

An ink jet printing method includes the steps of: shooting an ink containing a color material in a penetrant by ink jet method to a surface of a print medium; and supplying only a penetrant containing no color material at a position on the print medium corresponding to a position at which the ink has been shot to diffuse the supplied penetrant in the print medium in order to control distribution of the color material supplied in the print medium as the ink is shot at the print medium.

23 Claims, 15 Drawing Sheets

(56) References Cited

U.S. PATENT DOCUMENTS

| | | | | |
|---|---|---|---|---|
| 2005/0141001 | A1 | 6/2005 | Watanabe | |
| 2006/0071991 | A1 * | 4/2006 | Yamanobe | 347/95 |
| 2007/0064026 | A1 | 3/2007 | Hirakawa | |

FOREIGN PATENT DOCUMENTS

| | | | |
|---|---|---|---|
| JP | 08-216386 | | 8/1996 |
| JP | 08216386 | * | 8/1996 |
| JP | 10-076713 | | 3/1998 |
| JP | 11-129461 | | 5/1999 |
| JP | 2000-045188 A | | 2/2000 |
| JP | 2002-067292 | | 3/2002 |
| JP | 2002067292 | * | 3/2002 |
| JP | 2003-291484 A | | 10/2003 |
| JP | 2004-142205 | | 5/2004 |
| JP | 2004142205 | * | 5/2004 |
| JP | 2005-197791 A | | 7/2005 |
| JP | 2007-106117 | | 4/2007 |
| JP | 2007-152808 | | 6/2007 |
| JP | 2007152808 | * | 6/2007 |

OTHER PUBLICATIONS

Decision of Refusal issued by the Japanese Patent Office on Nov. 25, 2014 in connection with Japanese Patent Application No. 2012-502787.

* cited by examiner

METHOD AND DEVICE FOR ACHIEVING COLOR DEVELOPMENT ON A PRINT MEDIUM BY INK JET PRINTING

CROSS-REFERENCE TO RELATED APPLICATIONS

The present invention is a 35 U.S.C. 371 National Stage Entry of PCT/JP2010/004664, filed Jul. 21, 2010, which claims priority from Japanese Patent Application Nos. 2009-211579, filed on Sep. 14, 2009, and 2010-014756, filed on Jan. 26, 2010, the contents of all of which are herein incorporated by reference in their entirety.

TECHNICAL FIELD

The present invention relates to an ink jet printing method and an ink jet printing device and particularly to a method and a device for achieving color development on a print medium by ink jet printing.

BACKGROUND ART

Techniques for dyeing cloth, leather, etc. by ink jet method has been known in the art. Advantages of dyeing by ink jet method include excellent productivity and readiness with which design change requirements can be met.

On the other hand, printing by ink jet method could result in uneven dyeing because ink jet method, which achieves dyeing with aggregates of shot ink dots, were susceptible to the surface configuration of and the thickness variation in media to be dyed such as cloth and leather.

JP 2000-45188 A, for example, proposes natural or synthetic leather capable of reducing occurrence of dye unevenness in ink jet printing. In order to suppress the occurrence of dye unevenness, the leather therein proposed is previously provided on its surface with a penetration adjusting layer and a color development adjusting layer, the penetration adjusting layer containing a water repellent and a binder resin, the color development adjusting layer containing a cationic substance and a binder resin. These layers are formed by spray dry method, coating method, or the like.

CITATION LIST

Patent Literature

[PTL 1] JP 2000-45188 A

SUMMARY OF INVENTION

Technical Problem

However, it takes a significant amount of time and effort to form the penetration adjusting layer and the color development adjusting layer on the surface of leather to be dyed prior to printing. Besides, achieving a uniform distribution in the leather thickness direction or achieving a uniform color development into the reverse side of the leather was a difficult task.

The present invention has been made to overcome such problems associated with the prior art and has an object to provide an ink jet printing method and an ink jet printing device that easily achieves color development into the reverse side of a print medium.

Solution to Problem

An ink jet printing method according to a first aspect of the present invention comprises the steps of: shooting an ink containing a color material in a penetrant by ink jet method to a surface of a print medium; and supplying only a penetrant containing no color material to a position on the print medium corresponding to a position at which the ink has been shot to diffuse the supplied penetrant in the print medium in order to control distribution of the color material supplied in the print medium as the ink is shot at the print medium.

An ink jet printing device according to a second aspect of the present invention comprises: ink head unit for shooting a ink containing a color material in a penetrant; a penetrant supply unit for supplying only a penetrant containing no color material; and a control means for supplying only a penetrant containing no color material from the penetrant supply unit to a position on the print medium corresponding to a position at which the ink has been shot by the ink head unit to diffuse the supplied penetrant in the print medium in order to control distribution of the color material supplied in the print medium as the ink is shot at the print medium.

An ink jet printing method according to a third aspect of the present invention comprises the steps of: shooting a thick ink containing a color material having a high concentration by ink jet method to a surface of a print medium; and shooting a thin ink containing a color material having a low concentration by ink jet method at a position on the print medium corresponding to a position at which the thick ink has been shot to diffuse a penetrant contained in the thick ink and the thin ink in the print medium in order to control distribution of the color material supplied in the print medium as the thick ink and the think ink are shot at the print medium.

An ink jet printing device according to a fourth aspect of the present invention comprises: a thick ink head unit for shooting a thick ink containing a color material having a high concentration; a thin ink head unit for shooting a thin ink containing a color material having a low concentration; and a control means for shooting the thin ink from the thin ink head unit by ink jet method at a position on a print medium corresponding to a position at which the thick ink has been shot from the thick ink head unit to diffuse a penetrant contained in the thick ink and the thin ink in the print medium in order to control distribution of the color material supplied in the print medium as the thick ink and the think ink are shot at the print medium.

Advantageous Effects of Invention

According to the present invention, it is possible to easily achieve uniform color development into the reverse side of a print medium by ink jet method.

BEST MODE FOR CARRYING OUT THE INVENTION

The invention is described below in detail based on preferred embodiments illustrated in the accompanying drawings.

Embodiment 1

Figure 1:
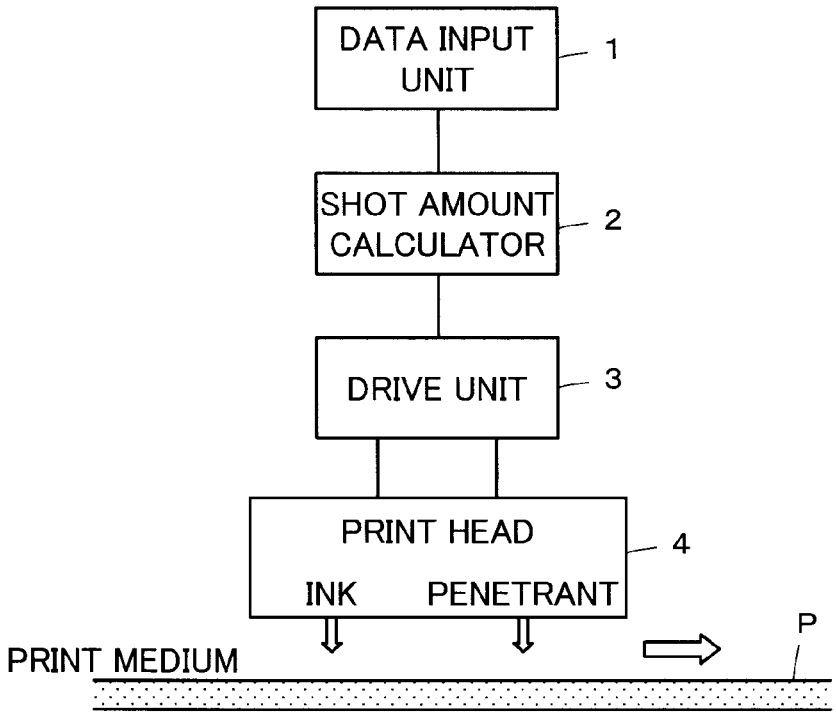
FIG. 1 is a block diagram illustrating a configuration of an ink jet printing device according to an embodiment 1 of the present invention.

FIG. 1 illustrates a configuration of an ink jet printing device according to the embodiment 1 of the present invention. The ink jet printing device comprises a data input unit 1, a shot amount calculator 2, a drive unit 3, and a print head 4.

The data input unit 1 is provided to enter information on a print medium P and information on a print image to be printed on the print medium P designated by an operator. The data input unit 1 may be configured by a keyboard, a mouse, etc.

The data input unit 1 is connected with the shot amount calculator 2. The shot amount calculator 2 calculates amounts of the ink and the penetrant to be shot continuously at each pixel position on the print medium P based on the information on the print medium P and the information on the print image entered through the data input unit 1.

The information on the print medium P includes color development characteristics resulting from printing a unit color material amount evenly on the print medium P and a color material distribution obtained as ink or penetrant is shot at the print medium P. The information on a print image includes information on target color development chromaticities at individual positions on the print medium P. Such information may be entered as chromatic coordinates such as CIEL*a*b*, XYZ (tristimulus value), etc. representing target color development chromaticity or as spectral reflectivity for each position on the print medium P.

For the purpose of the present invention, "ink" is defined as those in which color material is dissolved or dispersed in a penetrant to a given density. Further, the "color material" is used to allow color to develop and includes colorant, pigment, dye, paint, etc.; the "penetrant" is a solvent or a dispersion medium for dissolving or dispersing the color material.

The shot amount calculator 2 is connected with the drive unit 3. The drive unit 3 supplies the print head 4 with voltages according to the ink amount and the penetrant amount calculated by the shot amount calculator 2.

The drive unit 3 is connected to the print head 4. The print head 4 comprises an ink head unit for shooting ink and a penetrant head for shooting penetrant, and is a so-called ink-jet type print head that uses, for example, expansion and contraction of a piezoelectric element to shoot ink and penetrant. The voltages supplied from the drive unit 3 are applied to the ink head unit and the penetrant head unit to shoot ink and penetrant at the print medium P in order in their respective amounts calculated by the shot amount calculator 2.

The shot amount calculator 2 calculates a target color development (light reflection property of the print image) according to the information on the print medium P and the information on the print image entered through the data input unit 1 and calculates a color material amount for achieving the calculated target color development based on Kubelka-Munk theory expressed in formula (1) below. In the formula (1), K is the absorption intensity of the color material, S the light scattering intensity of the print medium P, and Rc the reflectance. The shot amount calculator 2 calculates a target penetration (penetration coefficient based on the thickness of the print medium P) according to the information on the print medium P entered through the data input unit 1 and calculates the color material distribution that depends on the penetrant amount according to the calculated target penetration using formula (2). In the formula (2), D is the distribution exponent of the color material, L the penetrant amount shot at the print medium P (including the penetrant amount contained in the shot ink), and F the color material penetration characteristics.

$$K/S=(1-Rc)^2/2Rc \quad (1)$$

$$dD/dL=F(D,L) \quad (2)$$

Figure 2:
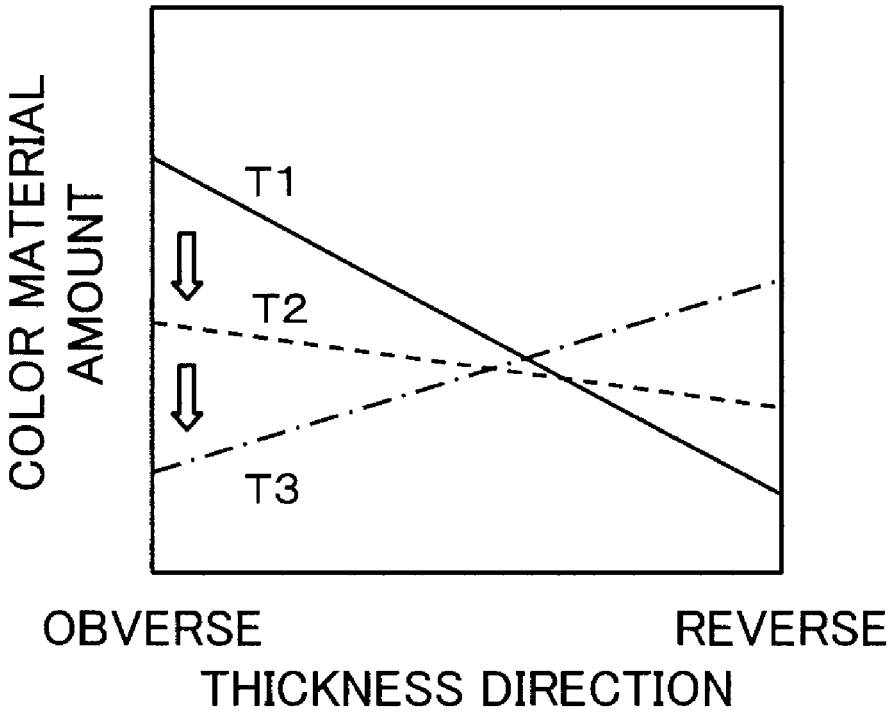
FIG. 2 is a graph illustrating a change in distribution of a color material that was shot at a printing medium.

FIG. 2 illustrates a change in color material amount occurring in the thickness direction of the print medium P as ink and penetrant are shot continuously at a given pixel position on the obverse side of the print medium P. As indicated by line T1 in FIG. 2, at a point in time when ink is shot at the print medium P, the color material amount is scarce on the reverse side as compared with the obverse side. When only penetrant is subsequently shot, the penetrant penetrates the print medium P in its thickness direction, causing also the color material to penetrate and move in that direction as indicated by line T2 in FIG. 2, so that the color material amount decreases on the obverse side while increasing on the reverse side. As the penetrant is further shot, the color material amount reverses between the obverse and reverse sides as indicated by line T3 in FIG. 2, so that the color material amount on the reverse side exceeds that on the obverse side.

Accordingly, the shot amount calculator 2 calculates an ink shot amount and a penetrant shot amount by using the formulae (1) and (2) such that the color material amount is evenly distributed throughout the thickness of the print medium P and the spectral reflectivity of the evenly distributed color material corresponds to a target color development.

Figure 3:
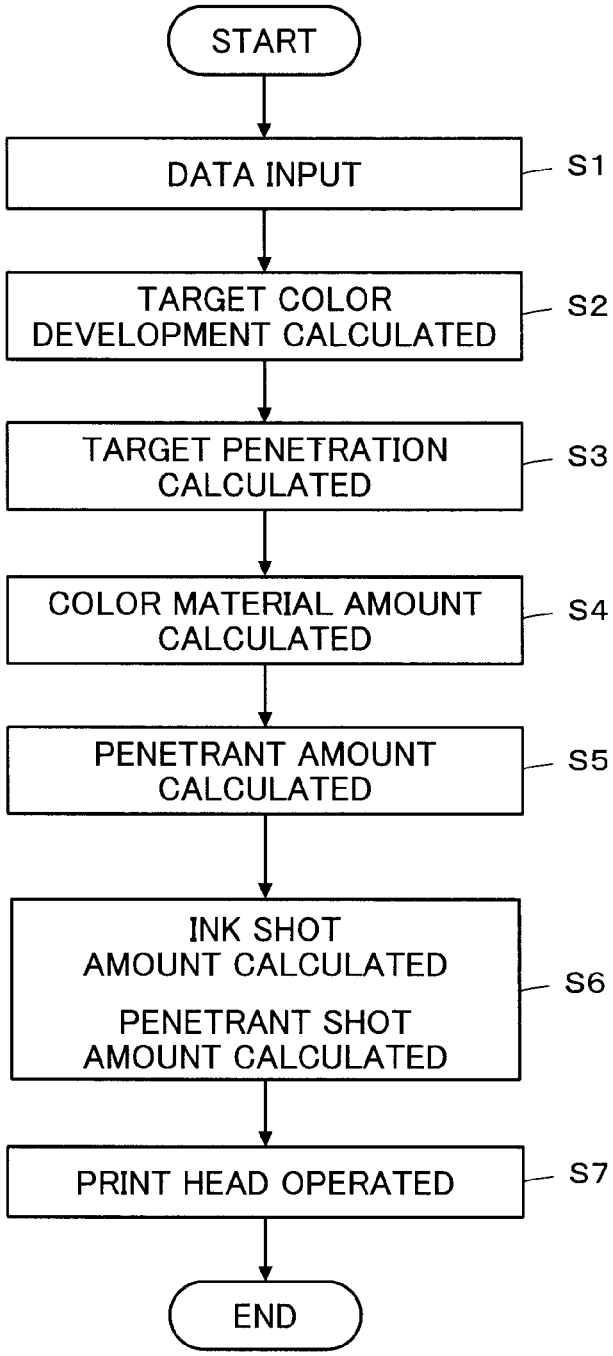
FIG. 3 is a flow chart illustrating an operation of the ink jet printing device according to the embodiment 1.

Next, operation of the ink jet printing device illustrated in FIG. 1 will be described referring to the flow chart of FIG. 3.

First, in step S1, an operator enters information on the print medium P and information on a print image to be printed on the print medium P designated by the operator through the data input unit 1, which information is both delivered to the shot amount calculator 2.

The shot amount calculator 2 calculates a target color development for each pixel in step S2 according to the information on the print medium P and the information on the print image entered through the data input unit 1 in step 1 and calculates a target penetration such as penetration coefficient based on the thickness of the print medium P included in the information on the print medium P separately for each pixel in step S3. Then in step S4, the shot amount calculator 2 uses the formula (1) to calculate a color material amount for achieving the target color development calculated in step S2 and, in step 5, uses the formula (2) to calculate a variation in color material distribution for achieving the target penetration calculated in step S3 and a penetrant amount for causing that variation in color material distribution.

The penetrant amount thus calculated represents the whole penetrant amount in relation to the color material and includes the penetrant amount contained in the ink.

In the following step S6, the shot amount calculator 2 uses the color material amount and the penetrant amount calculated in steps S4 and S5 to calculate an ink amount to be shot from the ink head unit and a penetrant amount to be shot from the penetrant head unit of the print head 4 separately for each pixel.

The ink amount and the penetrant amount thus calculated by the shot amount calculator 2 are transmitted to the drive unit 3, which in turn actuates the print head 4 in step S7 as follows.

Figure 4A:
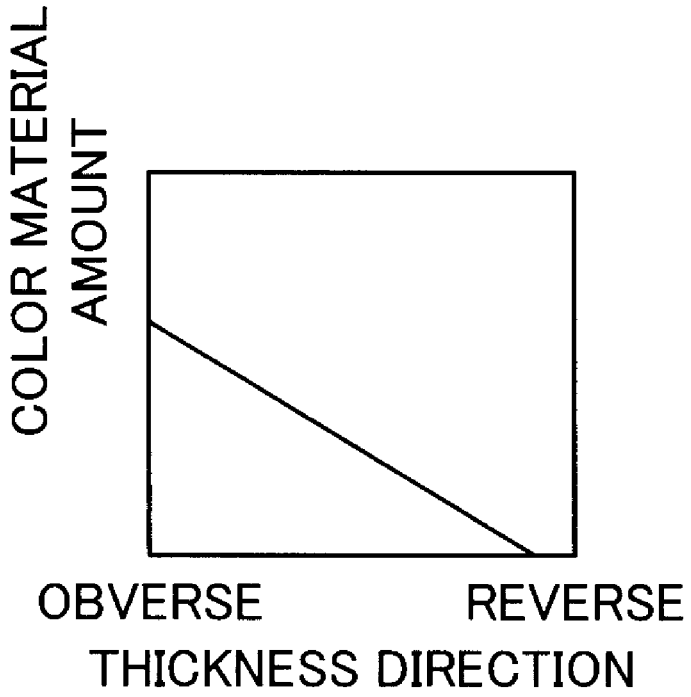
FIG. 4A is a graph illustrating a color material distribution as an ink was shot at a print medium.
Figure 4B:
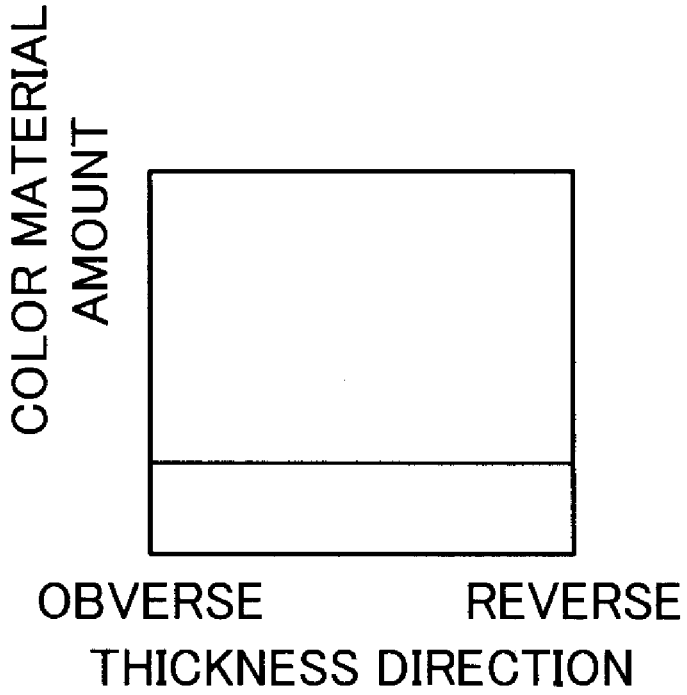
FIG. 4B is a graph illustrating a color material distribution as a penetrant was additionally shot at the printing medium.

The drive unit 3 supplies the ink head unit with a voltage according to the ink amount calculated by the shot amount calculator 2 to shoot the ink at a given pixel position on the print medium P. Upon the ink landing on the surface of the print medium P, the color material amount is great on the obverse side of the print medium P and is extremely small on the reverse side thereof as shown in FIG. 4A. Subsequently, the drive unit 3 supplies the penetrant head unit with a voltage according to the penetrant amount calculated by the shot amount calculator 2. Upon the penetrant landing on the position on the obverse side of the print medium P corresponding to a position hit by the shot ink (a given pixel position), the penetrant penetrates the print medium P in its thickness direction, causing the color material on the obverse side of the print medium P also to penetrate and move toward the reverse side, so that the color material amount is evenly distributed throughout the thickness of the print medium P as illustrated in FIG. 4B.

In associated operation with the transport of the print medium P effected by an unillustrated print medium transport means, the ink and the penetrant are also shot repeatedly at other pixel positions in the amounts calculated separately for each pixel, until a print of the print image entered at the data input unit 1 is completed.

According to the ink jet printing device of this embodiment, the shot amount calculator 2 controls the color material penetration distribution in the thickness direction of the print medium by virtue of the penetrant that is shot at a position on the obverse side of the print medium P corresponding to the color material shot position, thus inhibiting uneven color material distribution in the thickness direction of the print medium from occurring.

Although the color material amount distribution is controlled in the thickness direction of the print medium P in this embodiment, the color material amount distribution over the surface of the print medium P may be controlled. Upon successively shooting the ink and the penetrant at a given position on the print medium P, for example, the color material amount is distributed evenly in the surface direction of the print medium P as the penetrant diffuses. Therefore, the shot amount calculator 2 may be adapted to calculate an ink amount and a penetrant amount such that the spectral reflectivity due to that color material distributed evenly in the surface direction assumes a given value. Thus, color development can be evenly achieved within a given range of region on the surface of the print medium P.

Figure 5:
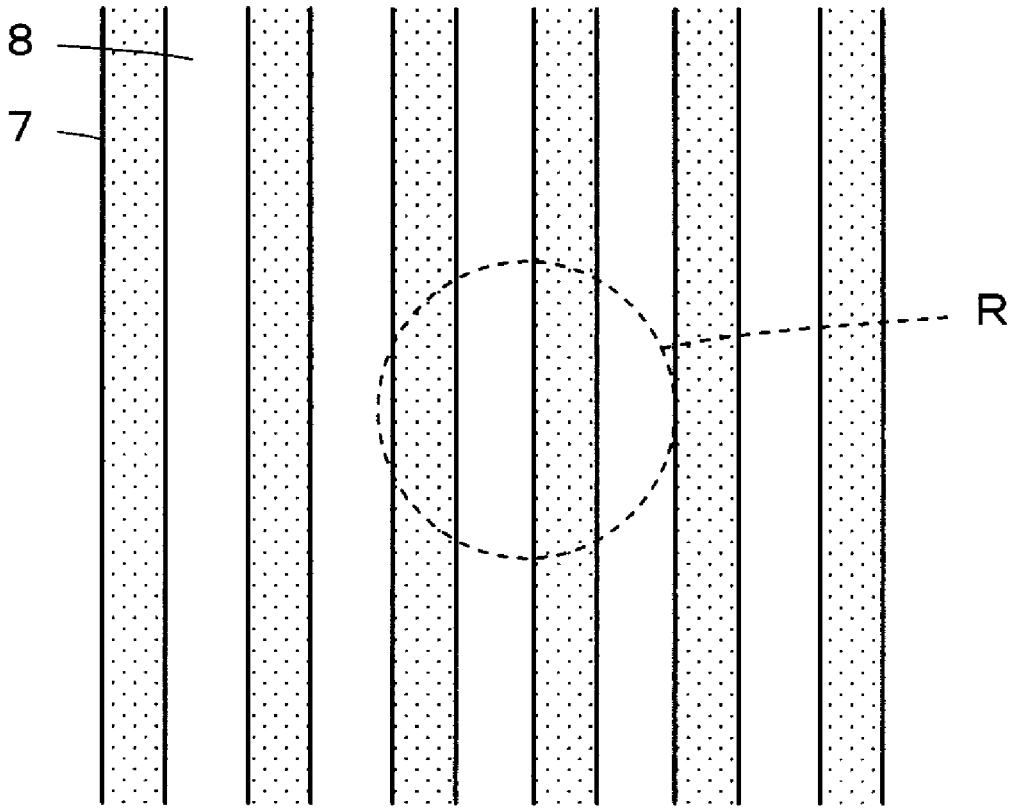
FIG. 5 illustrates an ink shot position on a printing medium having an uneven thickness.

Further, the shot amount calculator 2 may control the color material distribution over the surface of the print medium P having thicker portions 7 and thinner portions as illustrated in FIG. 5. Uniform color development can be achieved on the print medium P whose thickness varies from position to position by, for example, calculating the ink and penetrant amounts to be shot at a given position on the print medium P based on a mean thickness of the thicker portions 7 and the thinner portions 8 of the print medium P to permit shooting of the penetrant such that the color material diffuses evenly within a penetration region (a diffusion region R shown in FIG. 5) partly including the thicker portions 7 and the thinner portions 8.

Embodiment 2

Figure 6:
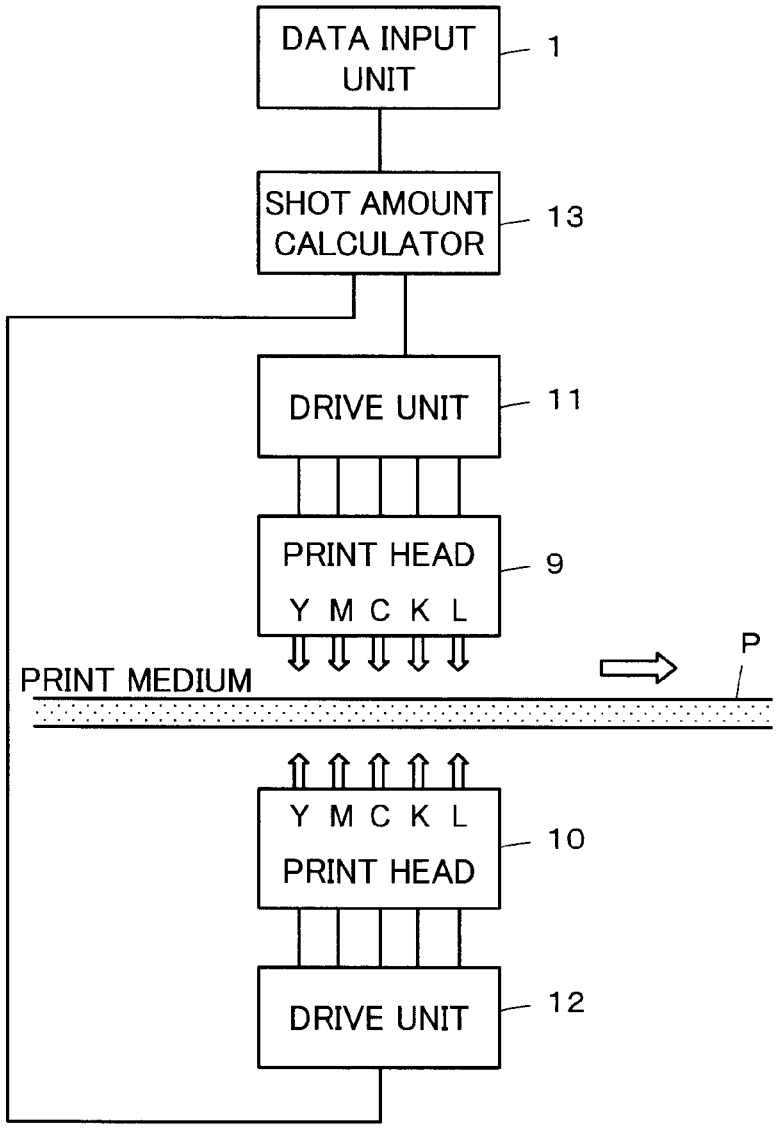
FIG. 6 is a block diagram illustrating a configuration of an ink jet printing device according to an embodiment 2.

FIG. 6 illustrates a configuration of an ink jet printing device according to an embodiment 2. Instead of the print head 4 in the embodiment 1 illustrated in FIG. 1, the ink jet printing device of the embodiment 2 has a first print head 9 and a second print head 10 disposed respectively on the obverse and reverse sides of the print medium P, each equipped with five head units composed of four kinds of ink head units Y, M, C, and K, and a penetrant head unit L. The first print head 9 and the second print head 10 are connected respectively to drive units 11 and 12, which in turn are connected to a shot amount calculator 13. Thus, the ink jet printing device of the embodiment 2 uses the shot amount calculator 13, the drive units 11, 12, and the print heads 9, 10 instead of the shot amount calculator 2, the drive unit 3, and the print head 4 in the ink jet printing device of the embodiment 1 illustrated in FIG. 1.

Figure 7:
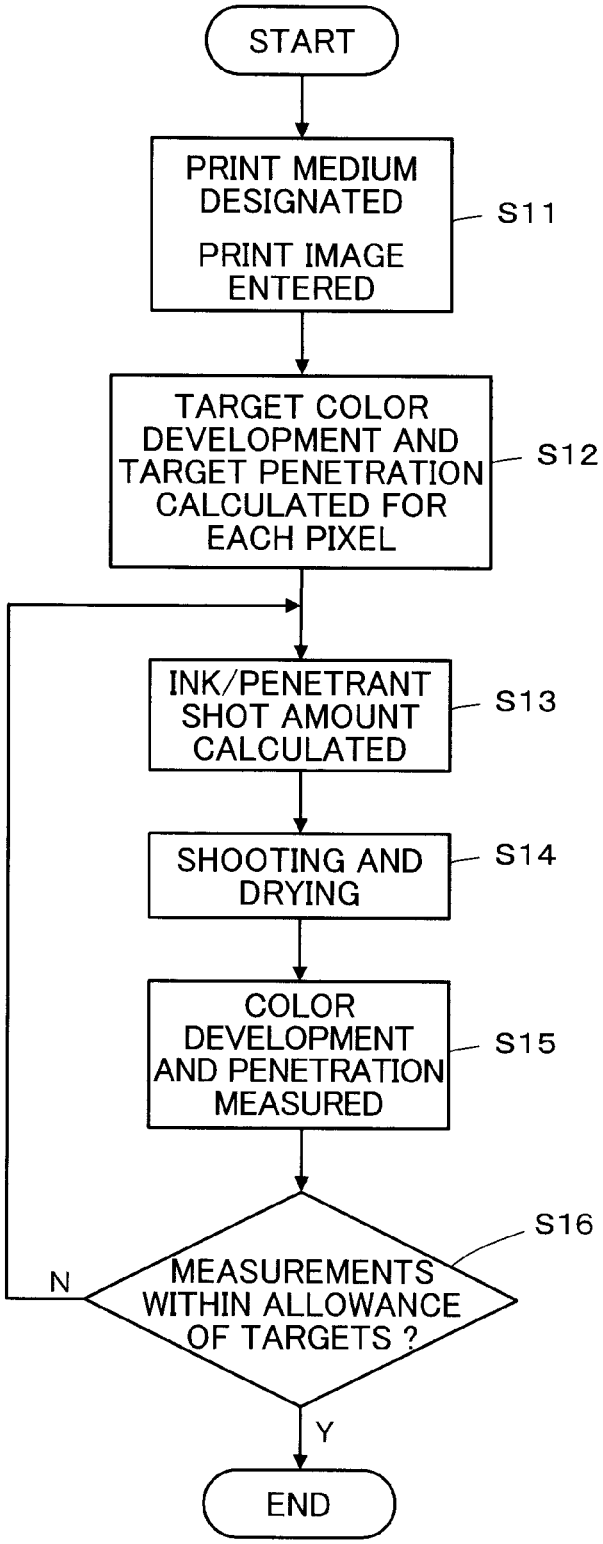
FIG. 7 is a flow chart illustrating an operation of the ink jet printing device according to the embodiment 2.

As illustrated in FIG. 7, the print medium P is designated and a print image is entered through the data input unit 1 in step S11, as in the case of the embodiment 1, for the shot amount calculator 13 to calculate a target color development and a target penetration in step S12 separately for each pixel. In this embodiment, the image uses a color that develops as two colors of ink blend.

Then, the shot amount calculator 13 calculates color material amounts for achieving the calculated target color development using two colors of ink that are shot sequentially at individual pixel positions on the print medium P based on Kubelka-Munk theory expressed in the formula (1) above and formula (3) below.

$$(K/S)\text{mix}=Jy(K/S)y+Jm(K/S)m+Jc(K/S)c+Jk(K/S)k \quad (3)$$

In the formula (3), (K/S)mix designates K/S of mixed color materials; (K/S)y, (K/S)m, (K/S)c, and (K/S)k designate K/S at the time when the four color materials are shot in their respective unit amounts; and Jy, Jm, Jc, and Jk designate printed amounts of the four color materials. Therefore, K/S in the case of mixed color materials is represented by the linear sum of K/S of the color materials. Such calculation, performed separately for each wavelength, yields a reflectance spectrum resulting from printing with four colors of ink.

The shot amount calculator 13 uses the formula (2) above to calculate a variation in color material distribution for achieving the target penetration and a penetrant amount for causing that variation in color material distribution.

The shot amount calculator 13 uses the color material amounts and the penetrant amount to calculate ink amounts and a penetrant amount to be shot from the head units of the first print head 9 and the second print head 10 in step S13.

In associated operation with the transport of the print medium P, two colors of ink and the penetrant are shot at individual pixel positions in given amounts, and then the printed medium P is allowed to dry, followed by heating and alkaline cleaning (color development treatment) to achieve color development in the print medium P in step S14. After the color development treatment, the light reflection properties at the individual pixel positions are measured on the obverse and the reverse sides of the print medium P to verify the color development and penetration of the color materials in step S15. In the following step S16, those measurements are checked to determine whether they are within an allowable range of the target value; the printing on the print medium P is terminated when they are within an allowable range. When the measurements are outside of the target value, the process returns to step S13 for the shot amount calculator 13 to correct the calculation parameters used in the formulae (1) to (3) and work out fresh ink and penetrant amounts to be shot, repeating the same shot until the measurements of the light reflection property fall within the allowable range of the target value. These steps improve the accuracy of the shot amount calculator 13.

According to the embodiment 2, the shot amount calculator 13 controls the penetration distributions of the color materials in the thickness direction of the print medium P, even where two colors of ink are mixed, by means of the two colors of ink and the penetrant shot from the first print head 9 and the second print head 10 respectively disposed on the obverse and reverse sides of the print medium P, thus inhibiting uneven color material distribution in the thickness direction of the print medium P from occurring.

Achieving a target color development by mixing two or more colors of ink as with the embodiment 2 requires more than one printing step to be taken. The change that will be caused by the Nth printing in color material distribution can be known from the penetrant amount, the color material amount, and the color material distribution in the immediately preceding (N−1)th printing and the penetrant amount and the color material amount in the Nth printing. Once the conditions of the printing steps are determined, the color material amounts as finally printed and the distribution characteristics can be obtained by calculation without carrying out printing.

Actually, an optimization technique is preferably used to find controlled variables equivalent to the target value, wherein the objective function is a color development characteristic (color development and color material distributions in the print medium) that is to be finally achieved, and the controlled variables are the penetrant amount and the color material amounts in each printing step. The optimization calculation may be performed using known methods including linear programming, successive approximation, and genetic method.

The above methods permit obtaining penetrant and ink amounts to be shot in each printing step for achieving a target color development (color development and color material distribution in a print medium). Among the image information entered through the data input unit calculation of information related to a typical target color development chromaticity may be omitted by previously obtaining the penetrant shot amount and the ink shot amount.

Described below is an example where printing was performed using a first color ink and a second color ink. In this example, printing was performed at a given pixel position on the obverse side of the print medium P by following the steps of printing with the first color ink, printing with the second color ink, and printing with the penetrant, followed by the step of printing with the second color ink at a given pixel position on the reverse side of the print medium P, to achieve a target color development. Table 1 shows the penetrant amount (including the penetrant contained in the ink), the first color material amount, and the second color material amount in each step and distributions of the first color and the second color resulting from the individual steps.

Figure 8:
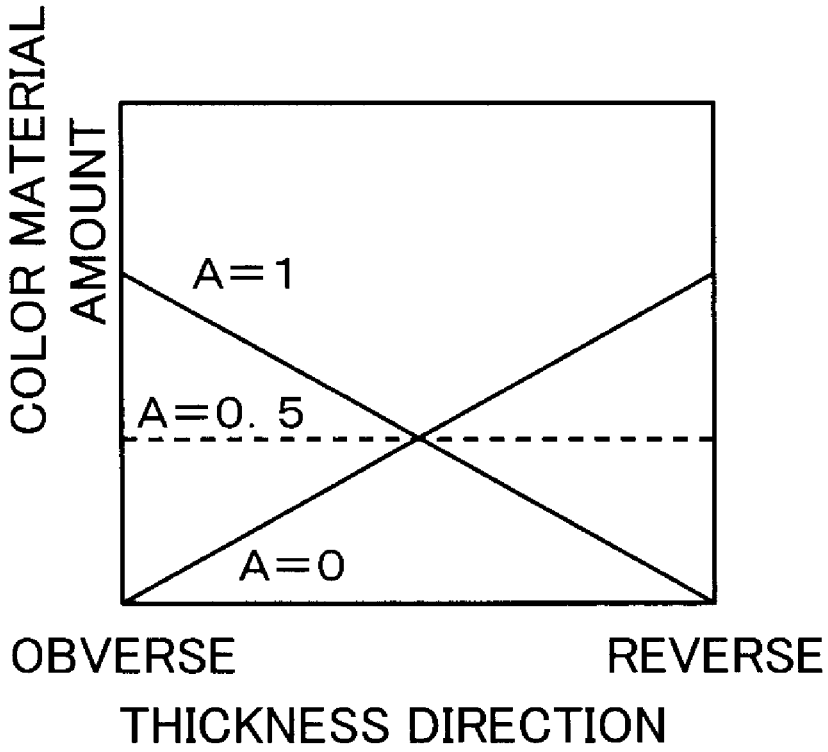
FIG. 8 is a graph illustrating basic color material distributions.

The penetrant amounts, the first color material, and the second color material are given in normalized figures for easy comparison of shot amounts in the individual printing steps. The first color distribution and the second color distribution in Table 1 represent the distributions of the respective color materials in the print medium P with a coefficient A of 0 to 1. As illustrated in FIG. 8, A=0.5 indicates a uniform color material distribution from the obverse side through the reverse side of the print medium P, A=1 indicates a distribution such that the color material on the obverse side of the print medium penetrated the print medium P to reach the reverse side, and A=0 indicates a distribution such that the color material on the reverse side of the print medium penetrated the print medium P to reach the obverse side.

TABLE 1

| Printing step | Penetrant | 1st color Color material amount | 1st color Distribution | 2nd color Color material amount | 2nd color Distribution |
|---|---|---|---|---|---|
| Obverse: printing with 1st color ink | 0.5 | 0.5 | 0.8 | | |
| Obverse: printing with 2nd color ink | 0.4 | | 0.6 | 0.4 | 0.8 |
| Obverse: printing with penetrant | 0.6 | | 0.4 | | 0.55 |
| Reverse: printing with 2nd color ink | 0.2 | | 0.5 | 0.2 | 0.5 |
| Results | 1.7 | 0.5 | 0.5 | 0.6 | 0.5 |

Figure 9A:
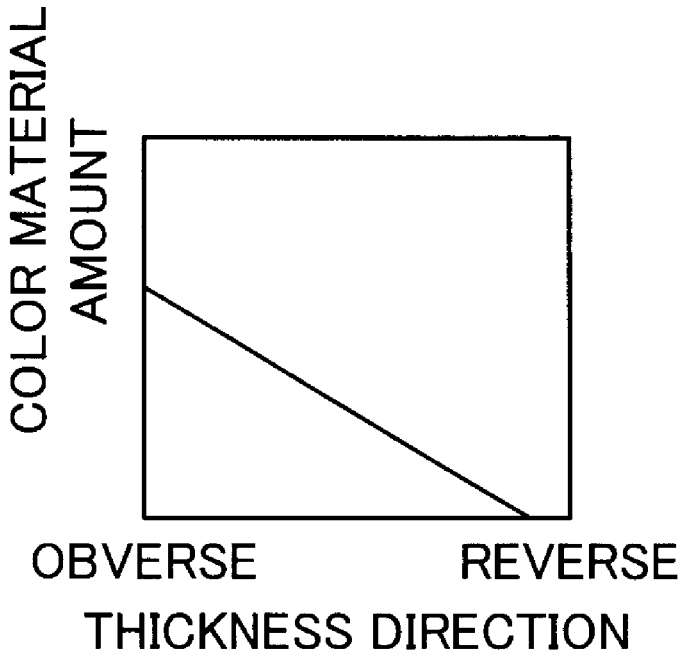
FIG. 9A illustrates a color material distribution obtained in a first printing step according to the embodiment 2.

First, a first color ink amount composed of a first color material amount 0.5 and a penetrant amount 0.5 is shot from the first print head 9 at a given pixel position on the print medium P. When the first color ink is shot, the first color distribution is 0.8 indicating that the first color material amount is great on the obverse side of the print medium P and is extremely small on the reverse side as illustrated in FIG. 9A.

Figure 9B:
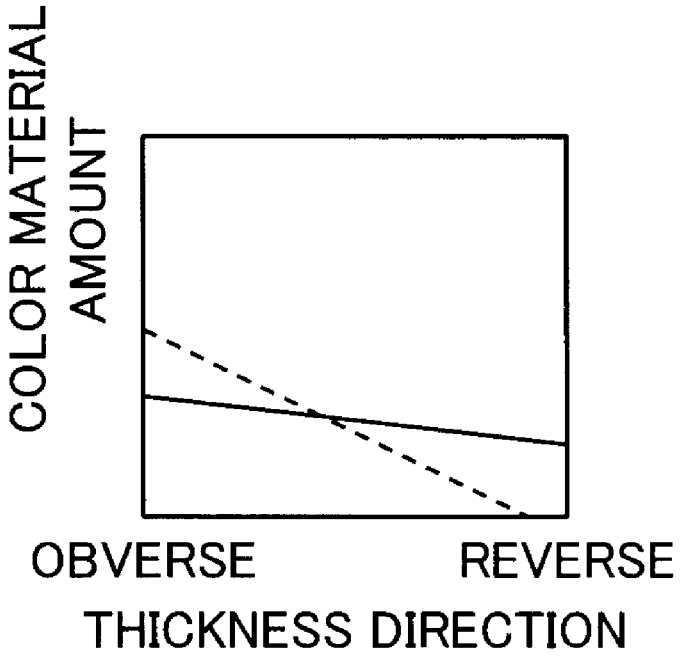
FIG. 9B illustrates color material distributions obtained in a second printing step according to the embodiment 2.

Then, a second color ink amount composed of a second color material amount 0.4 and a penetrant amount 0.4 is shot from the first print head 9. When the second color ink is shot at a position on the obverse side of the print medium P corresponding to the first color ink shot position (a given pixel position), the first color material penetrates the print medium P as the penetrant contained in the second color ink penetrates, causing the first color distribution to change to 0.6 and the second color distribution to change to 0.8. Thus, as illustrated in FIG. 9B, the distribution of the first color material amount becomes slightly more uniform in the thickness direction of the print medium P, while the second color material amount is great on the obverse side of the print medium and is extremely small on the reverse side.

Figure 9C:
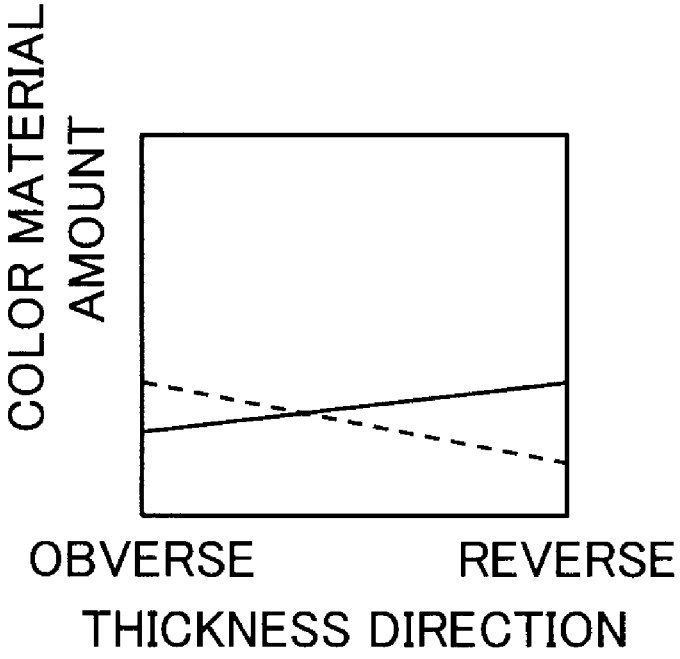
FIG. 9C illustrates color material distributions obtained in a third printing step according to the embodiment 2.

Next, a penetrant amount 0.6 is shot from the first print head 9. When the penetrant is shot at a position on the obverse side of the print medium P corresponding to the first color and the second color ink shot position (a given pixel position), the first color material and the second color material penetrate the print medium P as the penetrant penetrates, causing the first color distribution to change to 0.4 and the second color distribution to change to 0.55. Thus, the first color material amount is greater on the reverse side of the print medium P than the obverse side thereof while the second color material amount distribution evens out as illustrated in FIG. 9C.

Figure 9D:
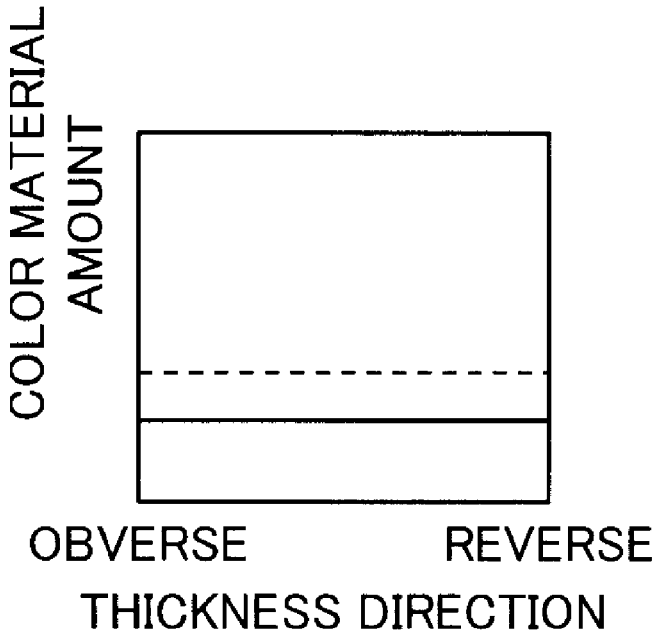
FIG. 9D illustrates color material distributions obtained in a fourth printing step according to the embodiment 2.

Then, a second color ink amount composed of a second color material amount 0.2 and a penetrant amount 0.2 is shot from the second print head 10. When the second color ink is shot at a position on the reverse side of the print medium P corresponding to a given pixel position, the first color material penetrates the print medium P in the same direction as the penetrant contained in the second color ink penetrates from the reverse side of the print medium P toward the obverse side, causing both the first color distribution and the second color distribution to change to 0.5, so that both the first color material amount and the second color material amount distributions even out in the thickness direction of the print medium P as illustrated in FIG. 9D.

Embodiment 3

An ink jet printing device according to an embodiment 3 has the same configuration as the ink jet printing device according to the embodiment 2.

As with the embodiment 2, the print medium P is designated and a print image is entered through the data input unit 1 for the shot amount calculator 13 to calculate a target color development and a target penetration. In this example, the image uses a color that develops as four colors of ink blend.

Then, the shot amount calculator 13 calculates color material amounts for achieving a target color development with four colors of ink that are shot sequentially at individual pixel positions on the print medium P based on Kubelka-Munk theory expressed in the formula (1) and the formula (3) above. The shot amount calculator 13 uses the formula (2) above to calculate a variation in color material distribution for achieving the target penetration and a penetrant amount for causing that variation in color material distribution. Then the shot amount calculator 13 uses the color material amounts and the penetrant amount to calculate four color ink amounts and a penetrant amount to be shot from the head units of the first print head 9 and the second print head 10 separately for each pixel position such that the distributions of the four color materials each even out and a color development closest to the target color development may be obtained.

The four color ink amounts and the penetrant amount calculated by the shot amount calculator 13 to be shot at a given pixel position are supplied to the drive units 11, 12 for the first print head 9 and the second print head 10, whereupon voltages corresponding to the ink amounts and the penetrant amount are applied to the first print head 9 and the second print head 10 to shoot the inks and the penetrant at a given pixel position on the print medium P.

When the shot amount calculator 13 determines that printing a bluish gray, for example, requires shot amounts of 0.02 for Y, 0.05 for M, 0.15 for C, and 0.3 for K (relative shot amounts), the four color material amounts can be evenly distributed in the thickness direction of the print medium P by shooting the individual inks at a given pixel position on the obverse and reverse sides of the print medium P in shot amounts given in Table 2.

TABLE 2

| | L | Y | M | C | K |
|---|---|---|---|---|---|
| First print head | 0.0 | 0.02 | 0.05 | 0.1 | 0.2 |
| Second print head | 0.2 | 0.0 | 0.0 | 0.05 | 0.1 |

Repeating like shots also at other pixel positions in associated operation with the transport of the print medium P results in printing an image where a color that develops as four colors blend is used, with the individual color material amounts evenly distributed in the thickness direction of the print medium.

Where a color to be developed in the print medium P requires five or more colors to be mixed, the same method may be used as with the embodiment 3 to achieve printing with the color material amounts evenly distributed in the thickness direction of the print medium P.

Figure 10:
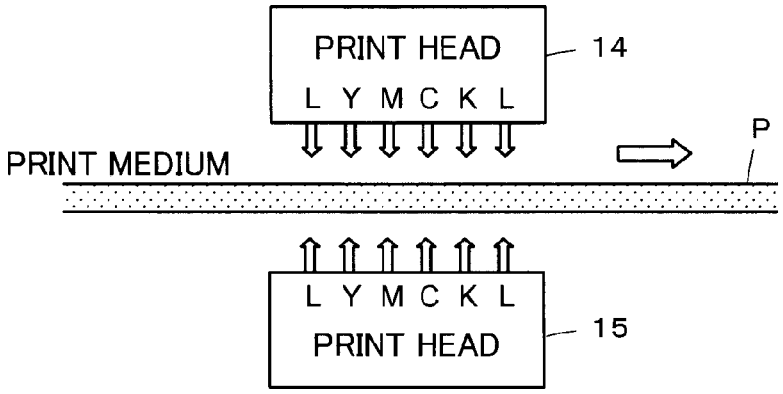
FIG. 10 illustrates print heads used in a variation of the embodiment 3.

The first print head 9 and the second print head 10 used in the embodiments 2 and 3 may have the penetrant head unit L disposed upstream of the ink head units Y, M, C, and K in the transport direction of the print medium P instead of downstream of the ink head units Y, M, C, and K in the transport direction of the print medium P. Alternatively, a first print head 14 and a second print head 15 may be used wherein, as illustrated in FIG. 10, two penetrant head units are each disposed upstream and downstream of the ink head units Y, M, C, and K in the transport direction of the print medium P.

Thus increasing the freedom with which ink penetrant is shot at the print medium P facilitates the control for evening out the color material amount distribution in the print medium P and color development.

Figure 11:
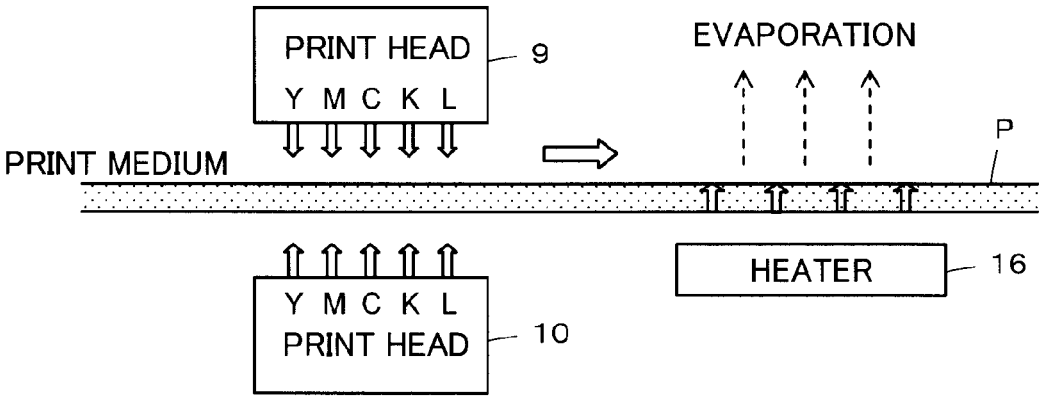
FIG. 11 is a block diagram illustrating a part of configuration of an ink jet printing device according to another variation of the embodiment 3.

Further, as illustrated in FIG. 11, a heater 16 may be provided downstream of the print heads 9 and 10 in the transport direction of the print medium P to dry the penetrant from one side of the print medium P. For example, the heater 16 may be provided on the underside of the print medium P to allow the penetrant to evaporate from the topside thereof facing the atmosphere, so that the penetrant moves from the reverse side toward the obverse side. This facilitates control of color material penetration into the print medium P.

Embodiment 4

Figure 12:
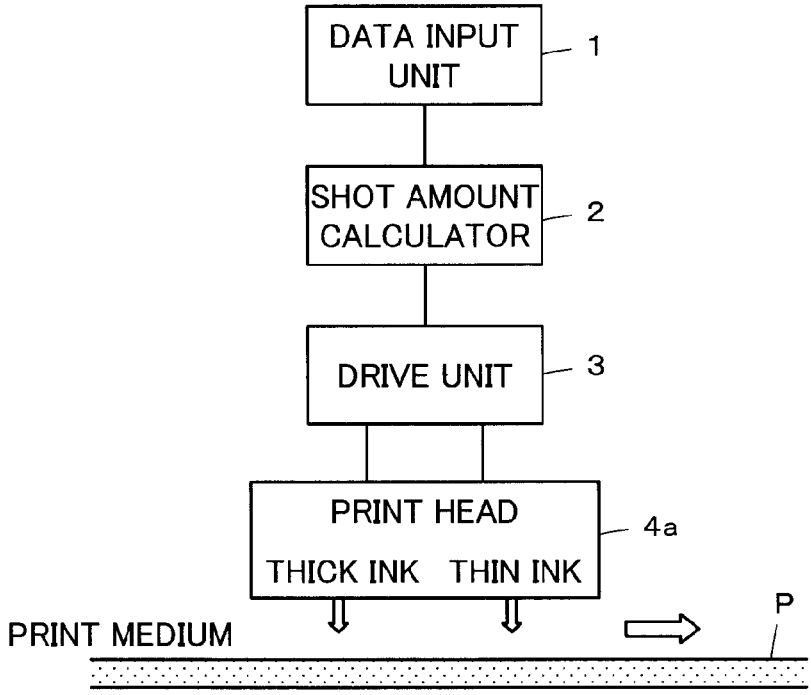
FIG. 12 is a block diagram illustrating a configuration of an ink jet printing device according to an embodiment 4.

FIG. 12 illustrates a configuration of an ink jet printing device according to an embodiment 4.

Color material distribution control as performed by the embodiments 1 to 3 requires printing a penetrant of 10% or more or preferably 30% or more of a maximum dip amount (a dip amount retained by the print medium that was immersed in a penetrant, the dip amount being measured after dripping caused by gravity stops). Accordingly, the embodiment 4 achieves the same color material distribution as with the embodiments 1 to 3 also by using a low-concentration ink containing a penetrant in an amount of 10% or more of a maximum dip amount (preferably 30% or more of a maximum dip amount) and a color material in an amount achieving a color development equivalent to or short of a target color development chromaticity instead of a penetrant containing no color material. Based on the above thought, the embodiment 4 controls color material penetration distribution in the print medium P using inks having different color material concentrations.

The ink jet printing device according to the embodiment 4 comprises a print head 4*a* connected to the drive unit 3 and having a thick ink head unit for shooting a thick ink containing a high-concentration color material and a thin ink containing a low-concentration color material instead of the print head 4 having the ink head units and the penetrant head unit in the ink jet printing device according to the embodiment 1 illustrated in FIG. 1. The thin ink contains a penetrant of 10% or more of a maximum dip amount and a color material achieving a color development equivalent to or short of a target color development chromaticity As with the embodiment 1, the shot amount calculator 2 calculates a target color development and a target penetration from entered information on the print medium P and a print image. Then, the shot amount calculator 2 calculates color material amounts for achieving a target color development based on Kubelka-Munk theory and finds a combination of shot amounts of a thick ink and a thin ink meeting the calculated color material amounts. Next, the shot amount calculator 2 calculates a color material distribution achieved by a penetrant amount from a target penetration to find one of thin/thick ink shot amount combinations permitting a uniform color material distribution. The thick ink amount and the thin ink amount thus found are transmitted to the drive unit 3, which applies corresponding voltages to the thick ink head unit and the thin head unit of the print head 4, causing the thick ink and the thin ink to be shot. Thus, the color materials can be distributed evenly in the thickness direction of the print medium P.

The embodiments 2 and 3 described earlier may also use a thick ink and a thin ink for each color instead of a penetrant containing no color material to achieve printing with a color material amount distribution evened out in the thickness direction of the print medium P.

Embodiment 5

Figure 13:
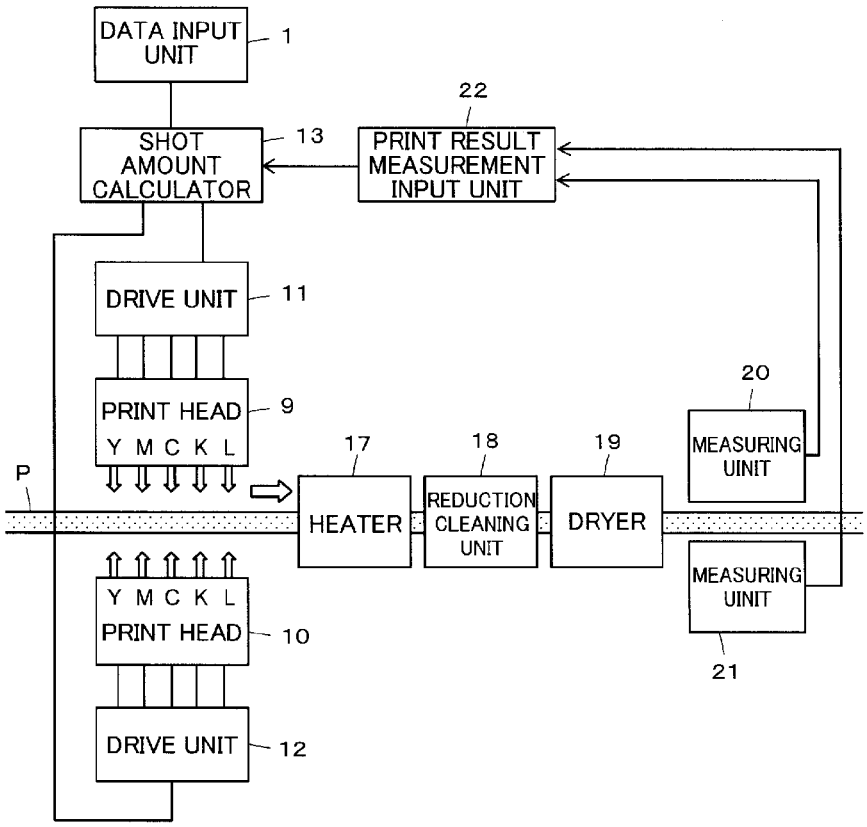
FIG. 13 is a block diagram illustrating a configuration of an ink jet printing device according to an embodiment 5.

FIG. 13 illustrates a configuration of an ink jet printing device according to an embodiment 5. Upon printing on the print medium P, in the embodiment 5, color material amounts and color material distribution in the print medium P are measured, and corrections are made such that target color material amounts and a target color material distribution are achieved based on the measurements to complete printing. The ink jet printing device according to the embodiment 5 has the same configuration as the ink jet printing device according to the embodiment 2 illustrated in FIG. 6 except that the former additionally comprises a heater 17, a reduction cleaning unit 18, a drier 19, and measuring units 20, 21 disposed in this order downstream of the print heads 9, 10 in the transport direction of the print medium P. The measuring units 20, 21 are connected to a print result measurement input unit 22, which in turn is connected to the shot amount calculator 13.

The heater 17 heats the print medium P upon completion of printing. The reduction cleaning unit 18 performs reduction cleaning of the print medium P by using a reduction cleaning aid such as hydrosulfite. The drier 19 dries the print medium P. The measuring units 20, 21 measure the optical properties of the print medium P from the topside and underside thereof and measure color development amounts; they comprise a dispersion colorimeter having an integrating sphere or an optical sensor calibrated with a dispersion colorimeter. The print result measurement input unit 22 enters the measurements obtained by the measuring units 20, 21 in the shot amount calculator 13 to feed back the results of print affected on the print medium P. The shot amount calculator 13 obtains corrected ink shot amounts and a corrected penetrant shot amount such that the measurements entered from the print result measurement input unit 22 agree with the target value (target color development chromaticity) related to the color material amounts and the color material distribution supplied from the data input unit 1.

Figure 14:
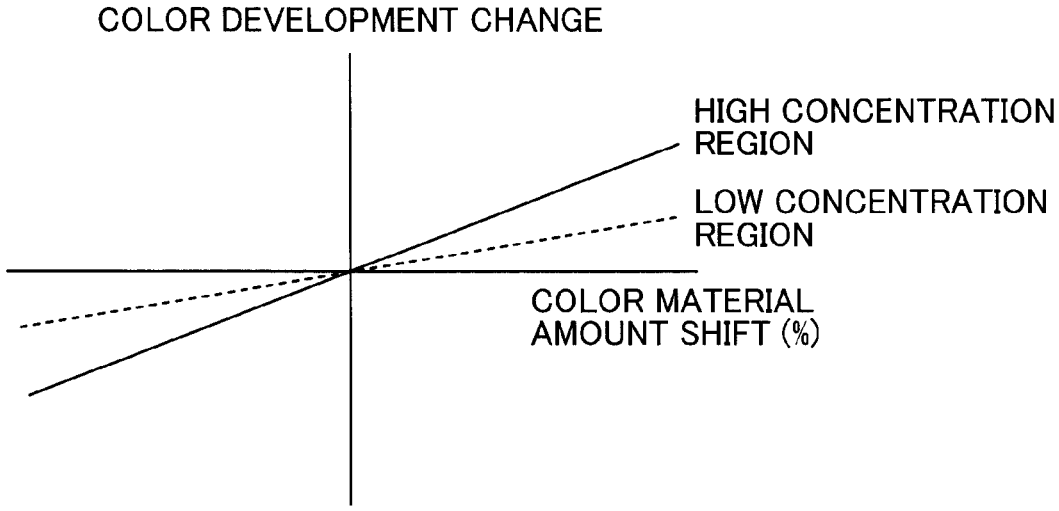
FIG. 14 illustrates how color development amounts vary with the total color material amount.

For example, the shot amount calculator 13 may have previously obtained a relationship between color material amount shift and color development amount change as illustrated in FIG. 14 and use this relationship to obtain a corrected total ink amount to be shot. Specifically, the shot amount calculator 13 uses the graph given in FIG. 14 to correct the shot color material amounts and obtain a total ink amount to be shot such that the measurements related to color development amount measured by the measuring units 20, 21 and entered from the print result measurement input unit 22 agree with the target color development chromaticity value supplied from the data input unit 1. There are cases where the rate of the change in color development amount to the change in color material amount varies between a high-concentration region with a large color material amount and a low-concentration region with a small color material amount. In such cases, correction graphs and formulae used for correction are preferably selected according to the total color material amount. In FIG. 14, for example, the solid line indicates a relationship between color material amount shift and color development amount change in a high-concentration region; the broken line indicates a relationship between color material amount shift and color development amount change in a low-concentration region.

Figure 15:
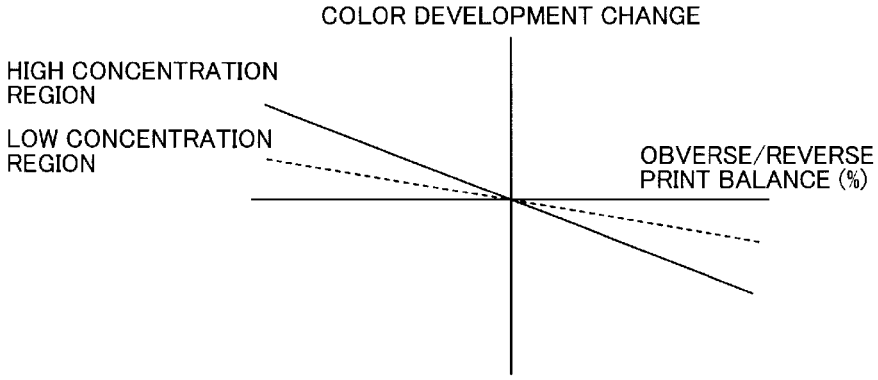
FIG. 15 illustrates how color development amounts vary with the obverse/reverse side print balance.

For example, the shot amount calculator 13 may have previously obtained a relationship between print balance shift of printed ink and color development amount change on the obverse and reverse sides as illustrated in FIG. 15 and use this relationship to obtain a corrected ink amount and a corrected penetrant amount to be shot from the print heads 9, 10. Specifically, the shot amount calculator 13 uses the graph given in FIG. 15 to correct the print balance on the obverse and reverse sides such that the measurements related to color development amount measured by the measuring units 20, 21 and entered from the print result measurement input unit 22 agree with the target color development chromaticity value supplied from the data input unit 1 to obtain ink amounts to be shot from the print heads 9, 10 In FIG. 15, the solid line indicates a relationship between ink print balance shift and color development amount change in a high-concentration region; the broken line indicates a relationship between ink print balance shift and color development amount change in a low-concentration region. Preferably, graphs and formulae are selected according to the total color material amount.

First, the shot amount calculator 13 calculates a target color development and a target penetration from information on the print medium P and a print image similarly entered as with the embodiment 2, and obtains the ink amounts and penetrant amount to be shot for achieving the calculated target color development and target penetration for the head units of the first and the second print heads 9, 10. Then, the drive units 11, 12 apply voltages corresponding to the ink amounts and the penetrant amount obtained by the shot amount calculator 13 to the print head units of the first and the second print heads 9, 10. The print medium P, now printed, is heated by the heater 17 and subjected to reduction cleaning by the reduction cleaning unit 18 before being dried by the drier 19. The dried print medium P is measured for color by the measuring units 20, 21 from the obverse and reverse sides of the print medium P; the measurements are sent through the print result measurement input unit 22 to the shot amount calculator 13. Where the supplied measurements are outside an allowable range of the target value (target color development chromaticity) of the color material amounts and the obverse/reverse print balance, the shot amount calculator 13 uses the relationships given in FIGS. 14 and 15 to obtain corrected ink amounts and penetrant amount to be shot from the head units of the first and the second heads 9, 10 so that the measurements supplied from the print result measurement input unit 22 agree with the target color development chromaticity. The drive units 11, 12 apply voltages corresponding to the ink amounts and the penetrant amount obtained by the shot amount calculator 13 to the pint head units of the first and the second print heads 9, 10. When a first attempt fails to contain the measurements in an allowable range of the target value (target color development (chromaticity) of the color material amounts and the obverse/reverse print balance, the above correction is preferably repeated until they are contained in the allowable range.

The embodiment 5 re-prints on the print medium P based on a correction amount obtained by feedback of the results of print applied to the print medium P. Thus, a difference or variation in color development amount can be effectively controlled even in cases where the initial calculation accuracies are poor or the physical properties of the inks, the printed medium P, etc. change with time or are changed by the environment.

According to the embodiment 5, the ink amounts and the penetrant amount to be shot from the print head units on a first shot need not necessarily be such values considering uniform distribution as described above but may be ones obtained by high-speed calculations using a simple method. For example, the shot amount calculator 13 may have each of the color material amounts calculated based on Kubelka-Munk theory and the penetrant amount calculated to achieve a favorable color material distribution of those color material amounts and output the halved amounts to the drive units 11, 12 so that the color materials and the penetrant are shot at the print medium P in the halved amounts from the obverse and reverse sides thereof. The color material amounts and the penetrant amounts are corrected so as to achieve uniform color material distribution in the print medium P by feedback of the results of print on the printed medium P. Use of such high-speed calculations achieves enhancement of calculation speed and reduction of calculation load.

The measuring units 20, 21 may carry out measuring offline and enter the measurements in the print result measurement input unit 22 instead of the measuring units 20, 21 entering the measurements online in the print result measurement input unit 22. Further, the measurements by the measuring units 20, 21 need not necessarily be measured color values; a book of sample color patches, for example, may be used to rank the differences from a target value and differences may be supplied from the print result measurement input unit 22.

Embodiment 6

In the ink jet printing device of the embodiment 2, the shot amount calculator 13 may be adapted to calculate an ink shot amount and a penetrant shot amount for at least one representative color from among a plurality of colors used to print an image on the print medium Pond work out shot amounts for the other colors by interpolation on the ink amount and the penetrant amount of the representative color.

Figure 16:
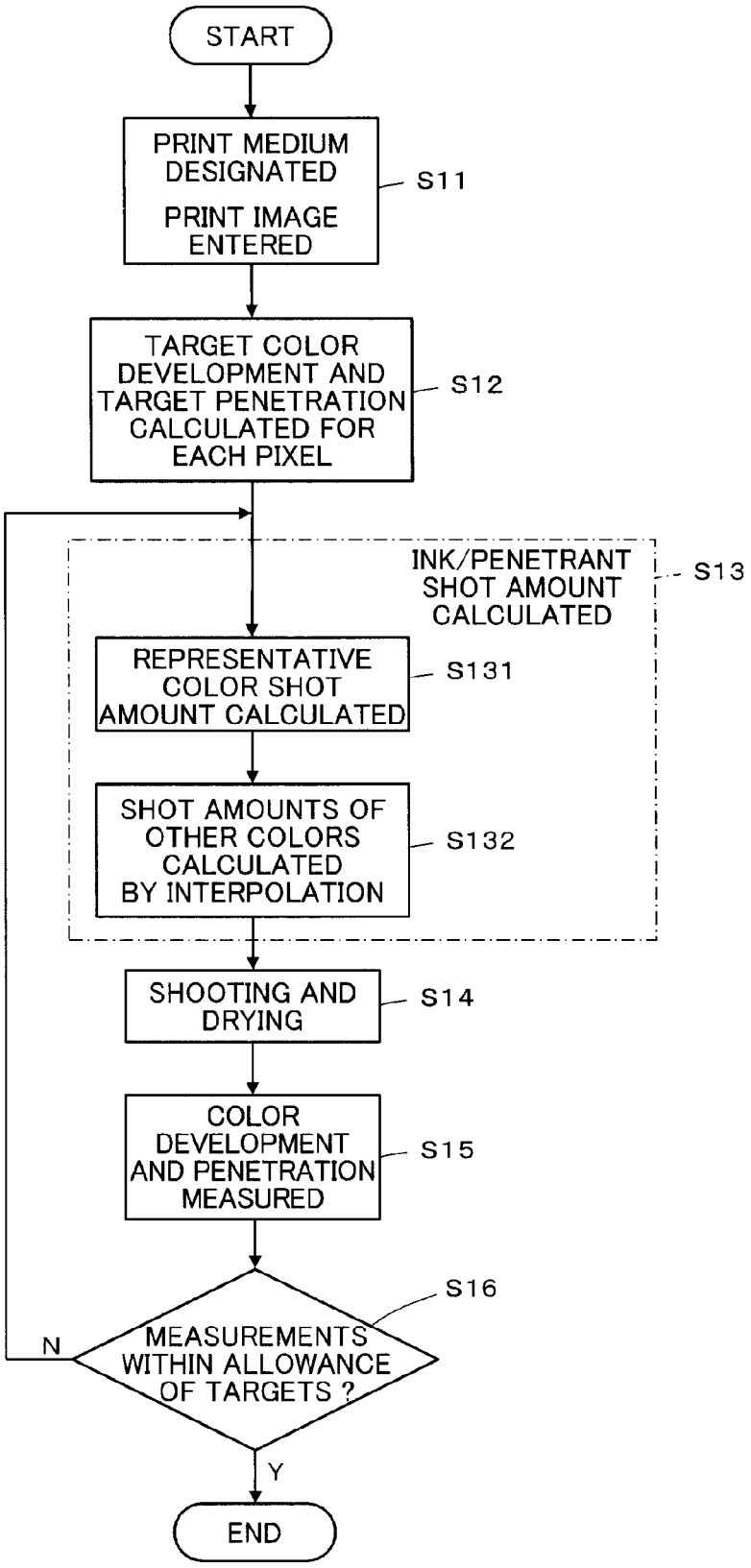
FIG. 16 is a flow chart illustrating an operation of an ink jet printing device according to an embodiment 6.
Figure 17:
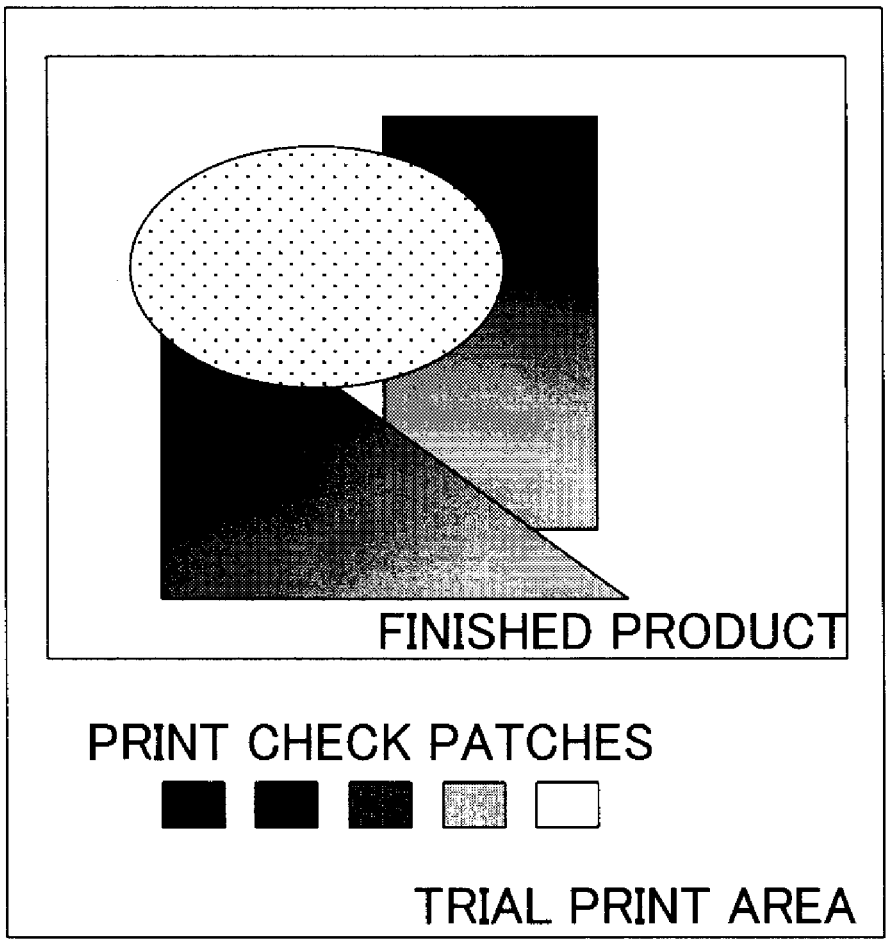
FIG. 17 illustrates print check patches of representative colors selected from a printed image.

First, as illustrated in FIG. 16, the print medium P is designated and a print image is entered through the data input unit 1 in step S11, as with the embodiment 2, for the shot amount calculator 13 to calculate a target color development and a target penetration in step S12. Next, in step S131, the shot amount calculator 13 places print check patches of a plurality of representative colors selected to cover the color regions of a print image in a trial print area outside the image as illustrated in FIG. 17 and calculates ink amounts and penetrant amount to be shot from the print head units to achieve a target color development and a target penetration for these representative colors. In step S132 to follow, the shot amount calculator 13 also calculates ink amounts and a penetrant amount to be shot for the other colors than the representative colors composing the image by interpolation on the calculated ink amounts and penetrant amount of the representative colors.

After shooting of the ink amounts and penetrant calculated by the shot amount calculator 13, the print medium P is dried and subjected to color development treatment in step S14. In step S15, the color development and penetration distribution of the color materials in the print medium P are measured, followed by judgment in step S16 as to whether the measurements are within the target value. When the measurements are outside of the target value, the process returns to step S131 for the shot amount calculator 13 to calculate the ink and penetrant amounts to be shot, repeating similar shots until the measurements fall within the allowable range of the target value.

Also with the embodiment 5, when correcting the ink amounts and the penetrant amount based on the measurements obtained by measuring the colors of the image printed on the print medium P, color measurement or calculation may be performed only for, a representative color, and the ink amounts and the penetrant amount for the other colors than the representative color may be obtained by interpolation.

According to the embodiment 6, calculation load can be reduced because the calculations are not performed on shot amounts for achieving a uniform color material distribution in the thickness direction of the print medium P for all the colors of the print image and because the color measurements are not performed on a print image thus printed for all the colors of the print image.

Embodiment 7

Figure 18:
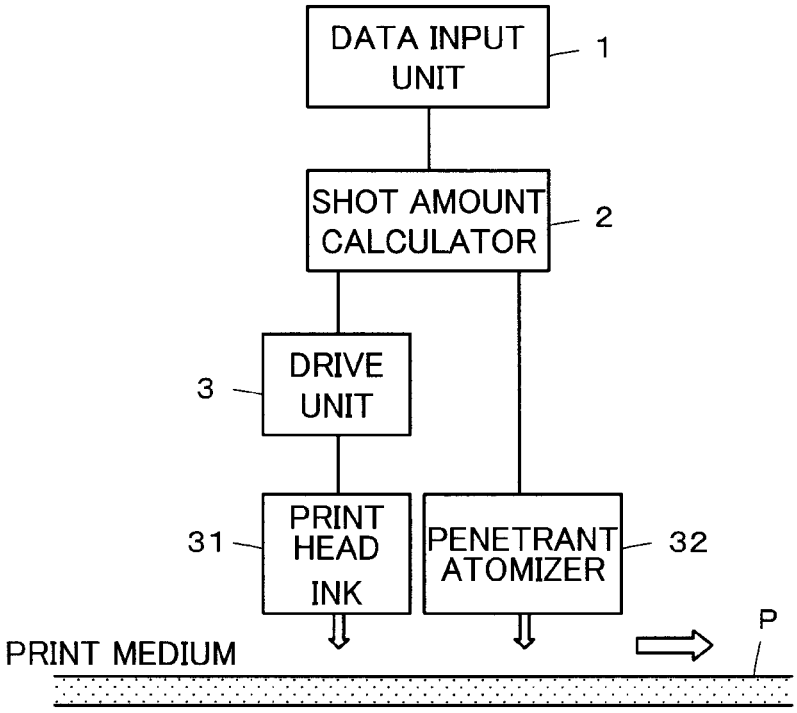
FIG. 18 is a block diagram illustrating a configuration of an ink jet printing device according to an embodiment 7.

FIG. 18 illustrates a configuration of an ink jet printing device according to an embodiment 7. The embodiment 7 comprises a print head 31 composed solely of ink head units instead of the print head 4 in the ink jet printing device according to the embodiment 1 and an additionally provided penetrant atomizer 32 connected to the shot amount calculator 2.

The penetrant atomizer 32 supplies a penetrant to the print medium P not by ink jet method but by atomizing the penetrant and may be of a type using ultrasound, air spray, or like means. The supply of atomized penetrant can be controlled using any known method including atomizing pulse width control.

As with the embodiment 1, the shot amount calculator 2 first calculates a target color development and a target penetration from entered information on the print medium P and a print image. Then, the shot amount calculator 2 calculates color material amounts and a penetrant amount for achieving a target color development and a target penetration and uses these values to calculate ink amounts to be shot from the ink head units of the print head 31 and a penetrant amount to be shot from the penetrant atomizer 32 separately for each pixel. The thus calculated ink amounts to be shot from the ink head units are transmitted to the drive unit 3, whereupon the drive unit 3 applies voltages corresponding to the calculated ink amounts to the ink head units so that inks are shot at a given pixel position on the print medium P. The penetrant amount calculated by the shot amount calculator 2 is transmitted to the penetrant atomizer 32, which supplies an atomized penetrant to a given pixel position on the print medium P in the calculated amount. Thus, supply of atomized penetrant instead of by ink jet method also enables a given amount of ink material to be evenly distributed in the thickness direction of the print medium P in a similar manner as with the embodiment 1.

Figure 19:
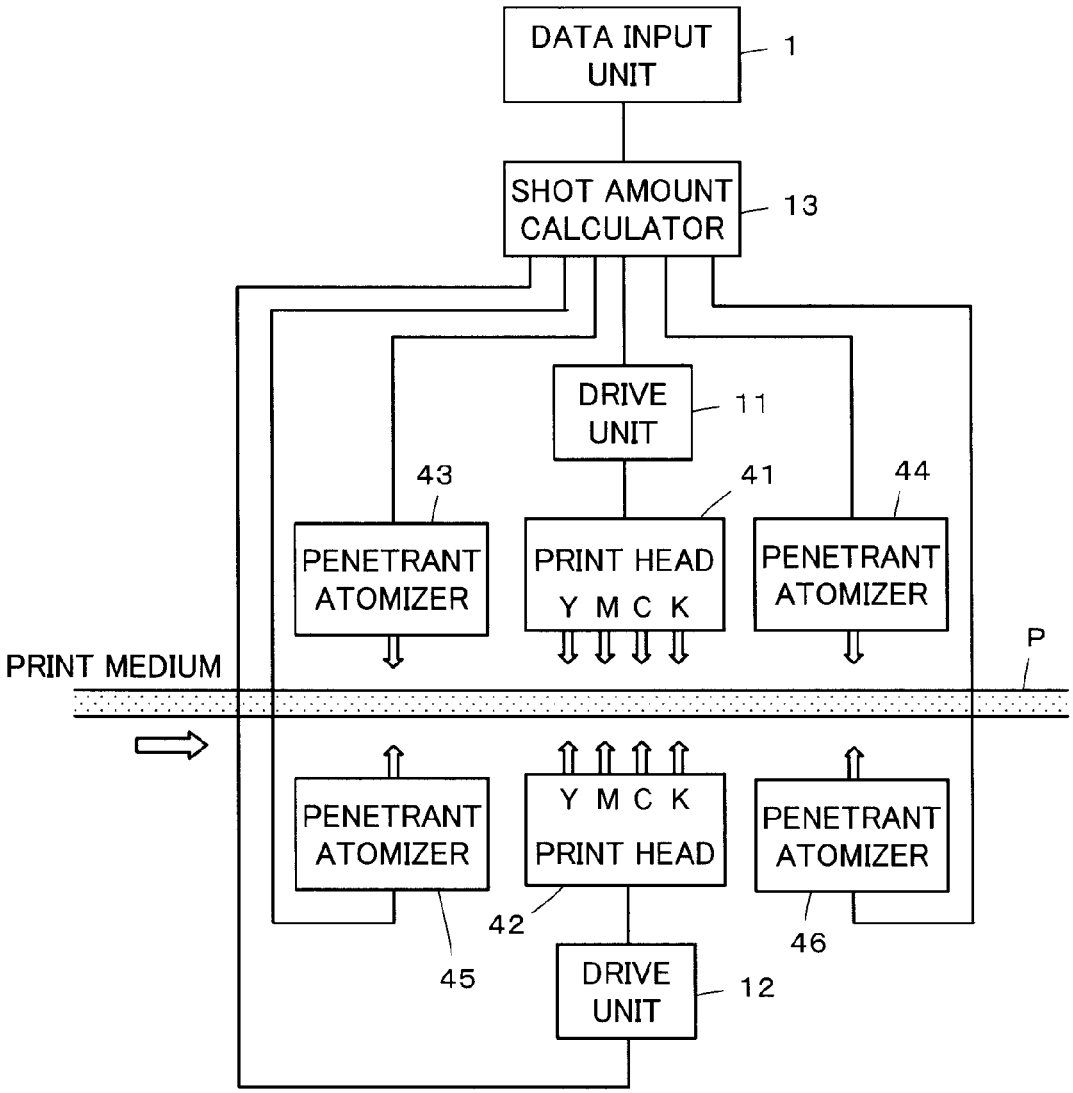
FIG. 19 is a block diagram illustrating a configuration of an ink jet printing device according to a variation of the embodiment 7.

As illustrated in FIG. 19, the embodiment 7 may comprise a first print head 41 and a second print head 42 composed solely of the ink bead units Y, M, C, and K and connected to the drive units 11, 12 instead of the first and the second print heads 9, 10 in the embodiment 2 and may additionally comprise penetrant atomizers 43 to 46 connected to the shot amount calculator 13. Thus, given amounts of color materials can be distributed evenly in the thickness direction of the print medium P similarly as with the embodiment 2.

In the illustrated example, the penetrant atomizers 43, 44 are disposed upstream and downstream of the first print head 41, respectively, while the penetrant atomizers 45, 46 are disposed upstream and downstream of the second print head 42, respectively. Note that at least one of these penetrant atomizers may be provided on the obverse and reverse sides of the print medium P so that color material distribution may be controlled in the thickness direction of the print medium P.

Because the penetrant atomizers are used to supply penetrant the embodiment 7, the ink jet printing device can be fabricated at lower costs than where the penetrant head unit L is used.

Although the penetrant atomizers of the embodiment 7 atomize and supply the penetrant in a given amount calculated separately for each pixel to a given pixel position, the penetrant atomizers may atomize and supply the penetrant in an amount calculated separately for each supply area containing a plurality of pixels to that supply area. For example, the penetrant amounts calculated separately for the respective pixels in each supply area by the shot amount calculator 13 may be averaged in each supply area to work out a penetrant amount for each supply area, which then may be atomized and supplied to the corresponding supply area by the penetrant atomizers.

Although the shot amount calculator of the respective embodiments 1 to 7 uses the above formulae (1) to (3) to calculate ink amounts and a penetrant amount to be shot at the print medium P, a table previously made by conducting experiments may be used instead. For example, such a table may contain a relationship between color development values obtained by varying the shot color material amounts and target color development values so that color material amounts required to be shot may be calculated by interpolation using the values of the table. Further, such a table may contain color material distributions obtained by varying the shot color material amounts and penetrant amount so that color material amounts and penetrant amount required to be shot from the print heads may be calculated using the table.

The shot amount calculator of the embodiments 1 to 7 may have therein stored color development characteristics of the inks, properties specific to the penetrant, the color materials, the material of the print medium P, etc. among the information on the printed medium P and the inks as color development parameters and penetration parameters for use in the above formulae (1) to (3).

Where the print medium P is a polyester fiber fabric, the color materials may be a disperse dye exemplified by Disperse Yellow 54, Disperse Red 60, and Disperse Blue 395, and the penetrant may be a dispersant exemplified by a surfactant (e.g. fatty acid compound) or a disperse medium that is obtained by adding a high boiling-point solvent (e.g. ethylene glycol and glycerol) to water. For example, a polyester fiber fabric is heated at a temperature of 180° C. to 200® C. for several tens of seconds in a treatment preceding ink jet printing, followed by printing with the color materials and the penetrant mentioned above. Then, the polyester fiber fabric is heated again at a temperature of 180° C. to 200° C. for 2 to 10 minutes, and then subjected to reduction cleaning in a water solution containing a reduction cleaning aid such as caustic soda and hydrosulfite at a temperature of 60° C. to 80° C. for 5 to 10 minutes, followed by water washing and drying. Thus, the polyester fiber fabric can be dyed.

Where the print medium P is a cotton fiber fabric, one may use a reactive dye exemplified by C. I. Reactive Red 1, CI Reactive Yellow 85, CI Reactive Yellow 95, CI Reactive Orange 12, CI Reactive Orange 13, CI Reactive Red 3:1, CI Reactive Red 218, CI Reactive Orange 35, CI Reactive Brown 11, CI Reactive Blue 49, and CI Reactive Blue 5. The reactive dye described above can be fixed to a cotton fiber fabric by, for example, ink-jet printing the dye onto the fabric, followed by vapor heating.

Referring to FIG. 6, each of the first and the second print heads 9 and 10 comprises one each of the print head units Y, M, C, K, and L. Instead of the first and the second print heads 9 and 10, one may alternatively use print heads provided with print head units disposed in arrays, each array of print head units being arranged in a direction normal to FIG. 6 and printing a same color. Thus, simply transporting the print medium P will result in printing a given width of area at a time. Each array of such print head units for printing a same color may be disposed closer to each other in a direction normal to FIG. 6 by arranging each array of print head units at an angle with respect to the transport direction of the print medium P, so that an enhanced printing resolution can be obtained on the print medium P. The same applies to the first and the second print heads 14 and 15 illustrated in FIG. 10.

REFERENCE SIGNS LIST

1 data input unit
2, 13 shot amount calculators
3, 11, 12 drive units
4, 4*a*, 31 print heads
7 thicker portions
8 thinner portions
9, 14 first print heads
10, 15 second print heads
16, 17 heaters
18 reduction cleaning unit
19 dryer
20, 21 measuring units
22 print result measurement input unit
32, 43, 44, 45, 46 penetrant atomizer
P print medium
R diffusion region

The invention claimed is:

1. An ink jet printing method for shooting an ink containing a color material in a penetrant at a surface of a print medium having a permeability to the ink and allowing a color to develop in the print medium, the method comprising the steps of:

entering information on the print medium and an image to be printed on the print medium;

calculating a target color development and a target color material distribution based on the entered information on the print medium and the image to be printed on the print medium;

calculating an amount of the ink to be shot and an amount of the penetrant to be supplied for achieving the calculated target color development and the calculated target color material distribution;

shooting the ink in the calculated amount of the ink to be shot by ink jet method to the surface of the print medium; and supplying only a penetrant containing no color material in the calculated amount of the penetrant to be supplied to a position on the print medium corresponding to a position at which the ink has been shot to diffuse the supplied penetrant in the print medium in order to control distribution of the color material supplied in the print medium as the ink is shot at the print medium.

2. The ink jet printing method according to claim 1, wherein the amount of the ink to be shot and the amount of the penetrant to be supplied are calculated so that the obverse and the reverse sides of the print medium attain a same color development.

3. The ink jet printing method according to claim 2, wherein the calculated target color development requires a plurality of inks each containing different kinds of color materials to be shot, the method further comprising the steps of:

calculating amounts of the plurality of inks to be shot; and shooting at least one ink of the plurality of inks to both the obverse and the reverse sides of the print medium.

4. The ink jet printing method according to claim 1, further comprising:

measuring a color developed on the print medium resulting from the shot of the ink and the supply of the penetrant;

correcting the calculated amount of the ink to be shot and the calculated amount of the penetrant to be supplied based on information on results of print medium color measurement and the printed image; and shooting the ink in the corrected amount of the ink to be shot and supplying the penetrant in the corrected amount of the penetrant to be supplied.

5. The ink jet printing method according to claim 4, wherein the print medium color measurement is performed offline according to a color patch sample book.

6. The ink jet printing method according to claim 1, wherein the entered information on the image to be printed contains a plurality of colors, the method further comprising the steps of:

calculating a target color development and a target color material distribution of at least one representative color among the plurality of colors, and calculating an amount of the ink to be shot and an amount of the penetrant to be supplied for the at least one representative color; and calculating amounts of the inks to be shot and amounts of the penetrants to be supplied for other colors than the at least one representative color based on the calculated amount of the ink to be shot and the calculated amount of the penetrant to be supplied for the at least one representative ink.

7. The ink jet printing method according to claim 1, wherein the amount of the ink to be shot and the amount of the penetrant to be supplied are calculated separately for each pixel based on the information on the print medium.

8. The ink jet printing method according to claim 1, wherein the amount of the ink to be shot and the amount of the penetrant to be supplied are calculated so as to obtain an even color development inside a given range of region on the surface of the print medium.

9. The ink jet printing method according to claim 1, further comprising the step of:

heating a part of the print medium to forcibly produce a flow of the penetrant in the print medium after supplying the penetrant.

10. The ink jet printing method according to claim 1, wherein the penetrant is shot at the print medium by ink jet method.

11. The ink jet printing method according to claim 1, wherein the penetrant is supplied to the print medium in an atomized form.

12. An ink jet printing device for shooting an ink containing a color material in a penetrant at a surface of a print medium having a permeability to the ink and allowing a color to develop in the print medium, the device comprising:

an ink head unit for shooting the ink;

a penetrant supply unit for supplying only a penetrant containing no color material;

a data input unit for entering information on the print medium and an image to be printed on the print medium;

a calculator for calculating a target color development and a target distribution of the color material based on information on the print medium and the image to be printed both entered through the data input unit and calculating an amount of the ink to be shot and an amount of the penetrant to be supplied for achieving the calculated target color development and the calculated target color material distribution; and drive units for operating the ink head unit so that the ink is shot in the amount of the ink to be shot calculated by the calculator and operating the penetrant supply unit so that the penetrant is supplied in the amount of the penetrant to be supplied calculated by the calculator to a position on the print medium corresponding to a position at which the ink has been shot by the ink head unit to diffuse the supplied penetrant in the print medium in order to control distribution of the color material supplied in the print medium as the ink is shot at the print medium.

13. The ink jet printing device according to claim 12, further comprising at least an ink head where the ink head units and the penetrant supply unit are disposed adjacent to each other.

14. The ink jet printing device according to claim 13, wherein the ink head unit comprises a plurality of ink heads arranged linearly for shooting a plurality of different kinds of color materials.

15. The ink jet printing device according to claim 14, wherein the penetrant supply unit comprises a pair of penetrant heads each disposed at both ends of the plurality of ink heads.

16. The ink jet printing device according to claim 13, the print head is provided on both the obverse and the reverse sides of the print head.

17. The ink jet printing device according to claim 12, further comprising:

a measuring unit for measuring a color developed on the print medium resulting from shot of the ink and supply of the penetrant; and a measurement input unit for entering the results of the color measurements obtained by the measuring unit into the calculator the calculator correcting the calculated amount of the ink to be shot and the calculated amount of the penetrant to be supplied based on the results of the color measurements and information on the image to be printed, the drive unit operating the ink head unit and the penetrant supply unit so that the ink is shot in the corrected amount of the ink to be shot and the penetrant is supplied in the corrected corrected amount of the penetrant to be supplied.

18. The ink jet printing device according to claim 12, wherein the calculator calculates a target color development and a target color material distribution of at least one representative color among a plurality of colors contained in the information on the image to be printed entered through the data input unit, calculates an amount of the ink to be shot and an amount of the penetrant to be supplied for the at least one representative color for achieving the calculated target color development and the calculated target color material distribution, and calculates amounts of the inks to be shot and amounts of the penetrants to be supplied for other colors than the at least one representative color based on the calculated amount of the ink to be shot and the calculated amount of the penetrant to be supplied for the at least one representative ink.

19. The ink jet printing device according to claim 12, wherein the calculator calculates the amount of the ink to be shot and the amount of the penetrant to be supplied separately for each pixel based on the information on the image to be printed.

20. The ink jet printing device according to claim 12, further comprising a heater for heating a part of the print medium to forcibly produce a flow of the penetrant in the print medium.

21. The ink jet printing device according to claim 12, wherein the penetrant supply unit is a penetrant atomizer for atomizing and supplying the penetrant to the print medium.

22. An ink jet printing method for shooting an ink containing a color material in a penetrant at a surface of a print medium having a permeability to the ink and allowing a color to develop in the print medium, the method comprising the steps of:

entering information on the print medium and an image to be printed on the print medium;

calculating a target color development and a target color material distribution based on the entered information on the print medium and the image to be printed on the print medium;

calculating an amount of the thick ink to be shot and an amount of the thin ink to be shot for achieving the calculated target color development and the calculated target color material distribution;

shooting a thick ink containing a color material having a high concentration in the calculated amount of the thick ink to be shot by ink jet method to the surface of the print medium; and shooting a thin ink containing a color material having a low concentration in the calculated amount of the thin ink to be shot by ink jet method at a position on the print medium corresponding to a position at which the thick ink has been shot to diffuse a penetrant contained in the thick ink and the thin ink in the print medium in order to control distribution of the color material supplied in the print medium as the thick ink and the think ink are shot at the print medium.

23. An ink jet printing device for shooting an ink containing a color material in a penetrant at a surface of a print medium having a permeability to the ink and allowing a color to develop in the print medium, the device comprising:

a thick ink head unit for shooting a thick ink containing a color material having a high concentration;

a thin ink head unit for shooting a thin ink containing a color material having a low concentration;

a data input unit for entering information on the print medium and an image to be printed on the print medium;

a calculator for calculating a target color development and a target distribution of the color material based on information on the print medium and the image to be printed both entered through the data input unit and calculating an amount of the thick ink to be shot and an amount of the thin ink to be shot for achieving the calculated target color development and the calculated target color material distribution; and a drive unit for operating the thick ink head unit so that the thick ink is shot in the amount of the thick ink to be shot calculated by the calculator and operating the thin ink head unit so that the thin ink is shot in the amount of the thin ink to be shot calculated by the calculator at a position on the print medium corresponding to a position at which the thick ink has been shot from the thick ink head unit to diffuse a penetrant contained in the thick ink and the thin ink in the print medium in order to control distribution of the color material supplied in the print medium as the thick ink and the think ink are shot at the print medium.

* * * * *